United States Patent [19]

Mitsugi et al.

[11] 4,074,089

[45] Feb. 14, 1978

[54] MULTIPLE PUSH-SWITCH APPARATUS HAVING FLEXIBLE ELEMENT PREVENTING SIMULTANEOUS ACTUATOR DEPRESSION

[75] Inventors: Itaru Mitsugi, Kadoma; Toshio Hayakawa, Katano, both of Japan

[73] Assignee: Matsushita Electric Industrial Co., Ltd., Osaka, Japan

[21] Appl. No.: 689,076

[22] Filed: May 24, 1976

[30] Foreign Application Priority Data

| | | |
|---|---|---|
| May 28, 1975 | Japan | 50-64487 |
| June 10, 1975 | Japan | 50-79268[U] |
| Mar. 17, 1976 | Japan | 51-32469[U] |

[51] Int. Cl.[2] ..... H01H 9/26

[52] U.S. Cl. ..... 200/5 E; 200/50 C; 200/67 DA; 200/76; 74/483 PB

[58] Field of Search ..... 200/5 R, 5 E, 5 EA, 200/5 EB, 50 C, 67 D, 67 DA, 67 DB, 76, 86 R, 1 R; 340/365 A; 74/483

[56] References Cited

U.S. PATENT DOCUMENTS

| | | | |
|---|---|---|---|
| 1,870,304 | 8/1932 | Wentzel | 200/5 E |
| 1,947,157 | 2/1934 | Harris | 74/483 UX |
| 2,721,487 | 10/1955 | Morey et al. | 74/483 PB UX |
| 3,109,587 | 11/1963 | Rooks et al. | 200/5 A X |
| 3,183,315 | 5/1965 | Kiely | 200/5 EB |
| 3,268,673 | 8/1966 | Bilek | 200/5 E |
| 3,306,998 | 2/1967 | Russell | 200/67 DB |
| 3,388,226 | 6/1968 | Willcox | 200/67 DA |
| 3,746,802 | 7/1973 | Sandi et al. | 200/50 C X |

FOREIGN PATENT DOCUMENTS

| | | | |
|---|---|---|---|
| 2,256,992 | 6/1973 | Germany | 200/86 R |

OTHER PUBLICATIONS

IBM Technical Disclosure Bulletin, "Hydraulically Controlled Keyboard Interlock Mechanism"; Easton, R.C.; vol. 14, No. 8, Jan. 1972, p. 2540.

*Primary Examiner*—James R. Scott

*Attorney, Agent, or Firm*—Stevens, Davis, Miller & Mosher

[57] ABSTRACT

The present invention relates to a multiple push-switch apparatus comprising an exclusion mechanism which includes a plurality of slidably supported operation bodies and a flexible body, any one of said plurality of operation bodies being able to move by means of said flexible body, and a plurality of electric switches which are driven by said plurality of operation bodies, respectively. In addition, there is provided a multiple push-switch apparatus especially suitable as a station selecting apparatus for a television receiver. The apparatus can be operated by the use of a soft touch, permits the employment of various operation body arrangements, and prevents simultaneous operation of a plurality of electric switches by mistake.

8 Claims, 28 Drawing Figures

MULTIPLE PUSH-SWITCH APPARATUS HAVING FLEXIBLE ELEMENT PREVENTING SIMULTANEOUS ACTUATOR DEPRESSION

BACKGROUND OF THE INVENTION

The present invention relates to a multiple push-switch apparatus which is provided with a plurality of electric switches and is adapted to operate only one of them at a time. In particular, there is provided a multiple push-switch apparatus comprising an exclusion mechanism in which, when any one of the electric switches in the open position is pushed, another switch in the closed position is opened and, at the same time, the pushed switch is closed. The invention also provides a multiple push-switch apparatus which is especially suitable as a station selecting apparatus for a television receiver. An object of the present invention is to provide a multiple push-switch apparatus which is simple in construction and can be switched by a soft pushing operation.

BRIEF DESCRIPTION OF THE DRAWINGS

Other objects, features and advantages of the present invention will be readily apparent from the detailed description taken in conjunction with the accompanying drawings, in which.

DESCRIPTION OF THE PREFERRED EMBODIMENTS

First of all, a multiple push-switch apparatus according to the prior art will be described in conjunction with FIGS. 1, 2 and 3.

Figure 1:
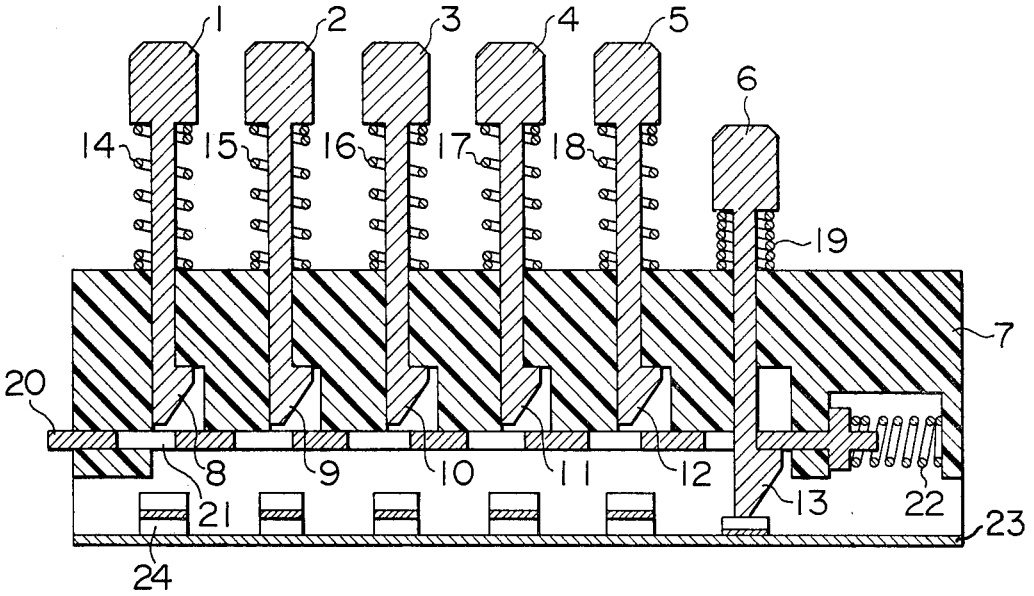
FIG. 1 PRIOR ART
FIG. 1 is a vertical cross-sectional view of an example of a multiple push-switch apparatus according to the prior art.
Figure 3:
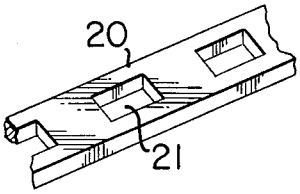
FIG. 3 is a perspective view of a part of the apparatus in FIG. 1.
Figure 2:
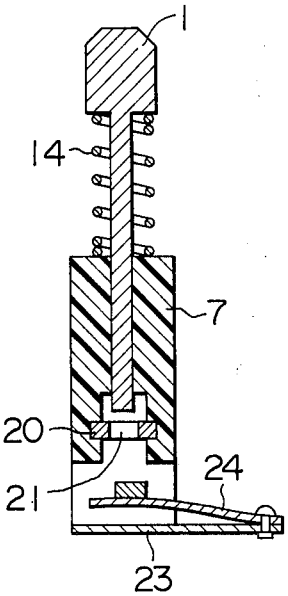
FIG. 2 is a lateral cross-sectional view of the apparatus in FIG. 1.

In FIGS. 1, 2 and 3, reference numerals 1 to 6 designate operation rods each of which is supported slidably vertically by a frame 7 and has at its lower portion each of cams 8 to 13 formed with an inclined surface. Reference numerals 14 to 19 designate springs for actuating the operation rods 1 to 6 upwards, respectively, reference numeral 20 designates a cam plate which has a plurality of cam openings (21) formed therein as shown in FIG. 3 and is supported slidably horizontally by the frame 7. Numeral 22 designates a spring for actuating the cam plate 20 to the left, numeral 23 designates a printed board which is fixed below the frame 7 and has fixed contacts formed in a conductor pattern thereon, and numeral 24 designates one of a plurality of plate springs each of which is fixed at one end to the printed board. The plate spring 24 is a movable contact and, together with the fixed contacts on the printed board 23, form a switch. Each of the switches is adapted to be closed when the other end of the plate spring 24 is depressed by the lower end of the operation rod so as to contact the fixed contact on the printed board.

In FIG. 1, the operation rod 6 is depressed so that the cam 13 of the operation rod 6 is engaged with the cam opening 21 in the cam plate 20 so as to maintain its depressed state. Under this condition, only the switch corresponding to the operation rod 6 is closed.

When, under the condition shown in FIG. 1, the operation rod 1, for example, is depressed, the cam 8 of the operation rod 1 causes the cam plate 20 to move to the right thereby disengaging the operation rod 6 from the cam opening 21 in the cam plate 20 so that the cam 8 of the operation rod 1 is engaged with the cam opening 21 in the cam plate 20, thus causing the switch corresponding to the operation rod 1 to be closed.

As described above, when any one of the operation rods is depressed, a switch corresponding to this operation rod is closed while, at the same time, the switch which has been closed is opened. That is, the depression of any one of the operation rods causes an exclusive selection operation.

However, the described prior art multiple push-switch apparatus has the following disadvantages.

(A) When two operation rods are depressed simultaneously, two switches corresponding to these operation rods are also closed. In order to prevent this misoperation, some special mechanism must be added.

(B) It is difficult to arrange single-row multiple push-switch apparatuses each as shown in FIG. 1 for a plurality of row to construct a multi-row multiple push-switch apparatus.

(C) When a multiple push-switch apparatus of more than some ten switches is to be manufactured, it is necessary to increase the accuracy of processing in each of the parts thus causing the cost.

(D) When an operation rod is depressed for switching, the feeling caused by the depressed operation rod being engaged with the cam plate and the feeling caused by another operation rod already engaged with the cam plate being disengaged therefrom are transmitted in two steps and therefore the feeling in operating is uncomfortable.

A multiple push-switch apparatus according to the present invention is constituted essentially of an exclusive operation mechanism, a bistable inversion mechanism and an electric switch mechanism.

Figure 4:
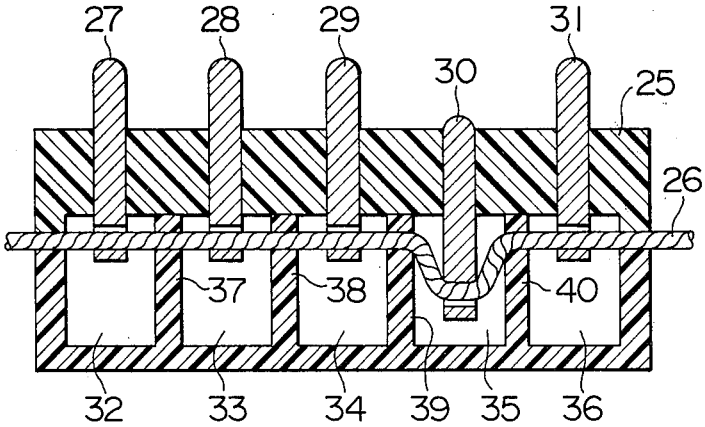
FIG. 4 is an example of an exclusion mechanism.

FIG. 4 shows an example of the exclusion operation mechanism. In FIG. 4, reference numeral 25 designates a supporting body which supports slidably a plurality of operation bodies 27 to 31. Numerals 32 to 36 designate gaps which are formed by the supporting body 25 and separating plates 37 to 40, numeral 26 designates a flexible linear body of rope or the like which is passed successively through the supporting body 25, openings formed in the separating plates 37 to 40 and openings formed in the operation bodies 27 to 31 and which is fixed at both ends in a state such that the rope has a certain slackness.

FIG. 4 shows a state in which the operation body 30 is depressed so that the linear body 26 is bent in a U shape at the portion corresponding to the operation body 30. Under the condition shown in FIG. 4, if the operation body 28, for example, is depressed downwards, the linear body 26 will be bent in a U shape at the portion corresponding to the operation body 28 while the other portions will be strained so that the portion corresponding to the operation body 30 will become linear. Thus, as a result of the linear body 26 being strained, the operation body 30 is raised.

Figure 5:
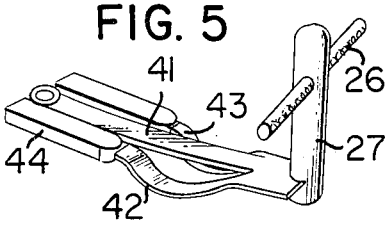
FIG. 5 is an example of a bistable inversion mechanism.

FIG. 5 shows an example of the bistable inversion mechanism which is arranged below each of the operation bodies 27 to 31. The bistable inversion mechanism comprises an inversion spring consisting of a central plate 41 and bent plates 42 and 43 arranged on both sides of the central plate 41, and a support member 44. An end portion of the plate 41 is fixed to the supporter 44 and the end portions of the bent plates 42 and 43 contact the side faces of the supporter 44. An end of the inversion spring is engaged with the operation body 27. The bistable inversion mechanism has two stable states, the first stable state being shown in FIG. 5. If, in the state shown in FIG. 5, the operation body 27 is pushed down, the inversion spring will be inverted so that the end of the inversion spring will be displaced downwards, and the state of the spring is transferred to the second stable state. By the inverting motion of the inversion spring, the movable contact of the electric switch is displaced, and thereby, the closing and opening of the electric switch is carried out.

Thus, the multiple push-switch apparatus according to the present invention comprises an exclusion mechanism having a plurality of operation bodies, a plurality of bistable inversion mechanisms which are driven by the operation bodies, respectively, and a plurality of electric switches which are driven by the bistable inversion mechanisms, respectively. When any one of the operation bodies is depressed, an electric switch corresponding to the operation body is closed and, at the same time, the electric switch which has been closed and the associated operation body are returned to their original positions.

Figure 6A:
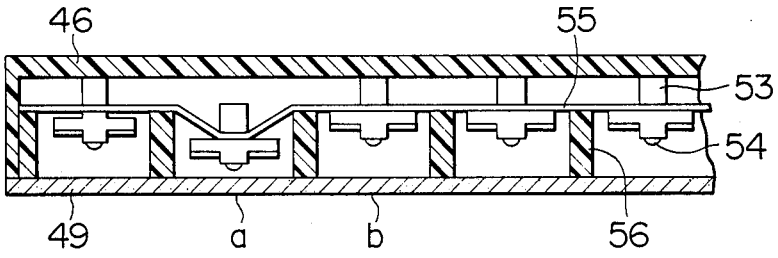
FIG. 6A is a longitudinal cross-sectional view of a first embodiment of a multiple push-switch apparatus according to the present invention.
Figure 6B:
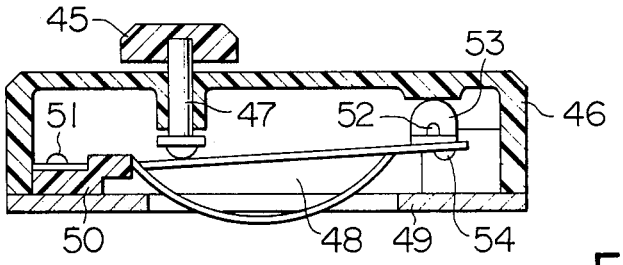
FIG. 6B is a lateral cross-sectional view of the embodiment of FIG. 6A.
Figure 6C:
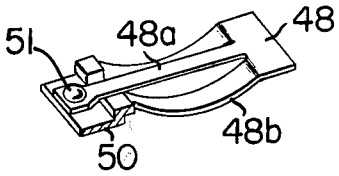
FIG. 6C is a perspective view of a part of the embodiment of FIG. 6A.

FIGS. 6A, 6B and 6C show an embodiment of the present invention. In FIGS. 6A and 6B, reference numeral 45 is one of a plurality of push-buttons which is engaged through a button axis 47 with a button opening in the frame 46 in such a manner that the push-button 45 can move vertically. Numeral 48 is an inversion spring which is provided, in contact with the lower end of the button sleeve 47, on a printed board 49 and can make a transition between two stable states. The bistable mechanism 48 consists, as shown in FIG. 6C, of a central portion **48*a* and bent lateral portions 48*b*, all of which are formed of a single rectangular elastic plate in which partial parallel cuts have been made. Portions 48*a* and 48*b* and are fixed at their respective ends to a mounting metal block 50, and the lateral portions 48*b* are bent and are adapted to be set in one of the two stable positions depending upon the direction of bending. Numeral 51 designates a supporting member of the mounting metal block 50 for securing the end of the central portion 48*a*. The inversion spring 48 is provided with an operation member 53 having a rope opening 52 on the upper surface of its free end and a contact rivet 54 on the lower surface. Thus, the contact rivet 54, the fixed member 51 of the mounting metal block 50 and the pattern provided on the portion of the printed board 49 which is to contact these together constitute a station selecting switch in a station selecting circuit of a television receiver, for example. Through the rope openings 52 of the operation bodies 53 arranged in parallel is passed a rope 55 which is fixed at both ends to the frame 46, and rope supporters 56 for supporting the rope 55 are provided between the neighboring operation bodies 53. The rope 55 has a slackness such that any one of the operation bodies 53** can move vertically between the closed and opened positions.

In the construction shown in FIG. 6A, only the switch for the station (a) is closed and all the other switches are opened. Now, if the push-button 45 of a switch other than (a), e.g., (b) is pushed, the inversion spring 48 which is in contact with the lower end of the button axis 47 is pressed so that the loose end of the inversion spring 48 is inverted downward, the bending of the lateral portions **48*b* is inverted and the contact rivet 54 is brought into contact with the corresponding pattern on the printed board 49 to close the station selecting switch (b) while the inversion spring is set in a stable state. Then, the rope 55 is in a strained state, the inversion spring 48 of the switch (a) is biased upward, the bending of both of the lateral portions 48*b* is inverted to cause the switch (a) to be returned to the opened state and the inversion spring 48 is set in a stationary state. The same action is taken also by the other switches and thus all the switches together constitute an exclusion circuit. Further, when the slackness of the rope 55 is suitably adjusted, two switches can never be in the closed state simultaneously. When the push-button 45 is located rather near the mounting end of the inversion spring 48, it is possible to make the pushing stroke very small without greatly increasing the necessary pushing force. When it is desired to increase the pushing stroke while reducing the pushing force, the position of the push-button 45 may be moved away from the mounting end of the inversion spring 48**.

Figure 7A:
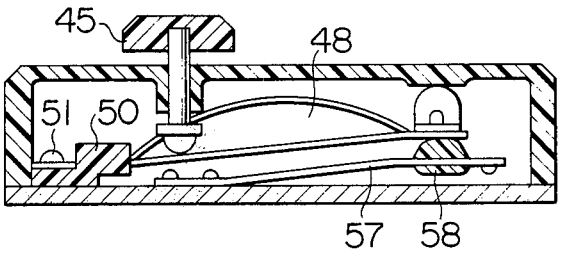
FIG. 7A is a lateral cross-sectional view of a second embodiment of a multiple push-switch apparatus according to the present invention.
Figure 7B:
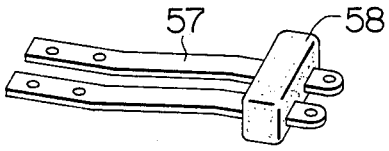
FIG. 7B is a perspective view of a part of the embodiment of FIG. 7A.

In the above embodiment, only one circuit at a station can be opened or closed for station selection. However, when opening or closing of two to four switches for a station are required as in the case of a television receiver, this requirement can be satisfied by constructing the apparatus such that a desired number of plate springs 57 which are connected through a non-conductive member 58 are provided below the inversion spring 48, as shown in FIGS. 7A and 7B as a second embodiment. In this way, a plurality of switches are interlocked.

Figure 8:
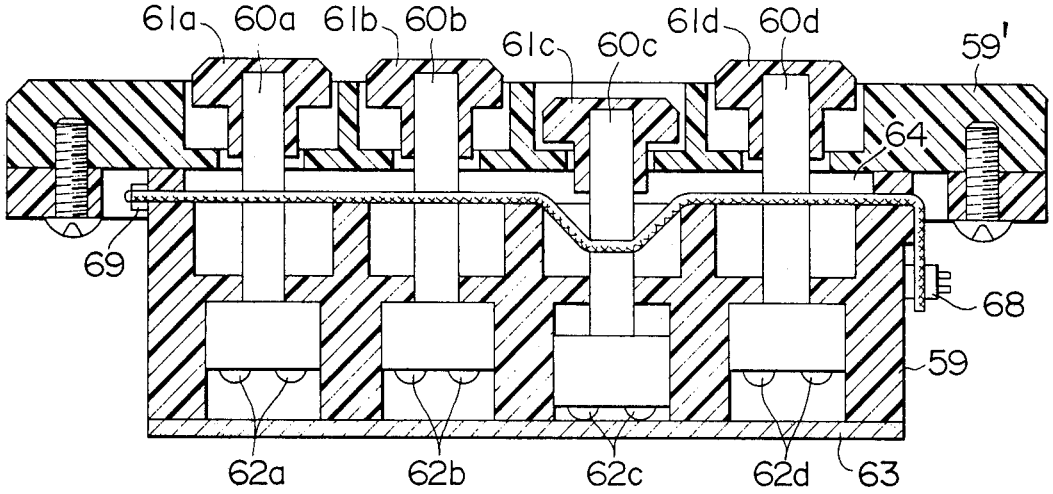
FIG. 8 is a longitudinal cross-sectional view of a third embodiment of a multiple push-switch apparatus according to the present invention.
Figure 9:
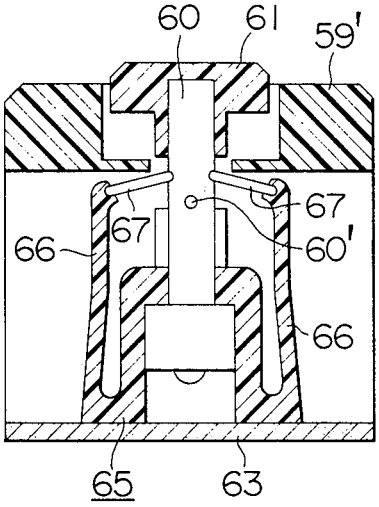
FIG. 9 is a lateral cross-sectional view of the embodiment of FIG. 8.

FIGS. 8 to 11 show a third embodiment of the present invention. In FIGS. 8 and 9, reference numeral 59 designates a housing having a panel 59' mounted thereon. A plurality of operation bodies 60*a*, 60*b*, 60*c* and 60*d* are slidably supported by the housing 59 and the panel 59'. Numerals 61*a*, 61*b*, 61*c* and 61*d* are push-buttons which are mounted on the operation bodies 60*a*, 60*b*, 60*c* and 60*d*. Under the operation bodies 60*a*, 60*b*, 60*c* and 60*d*, there are provided movable contacts 62*a*, 62*b*, 62*c* and 62 *d*, which can short circuit fixed contacts consisting of a conductive pattern formed on a printed board 63. Numeral 64 designates a flexible wire such as a rope which is strained with a certain slackness through openings 60' formed in the operation bodies and is fixed at one end while connected at the other end with an adjusting mechanism as will be described hereinafter.

FIG. 9 shows a bistable inversion mechanism of the operation body 60. In FIG. 9, numeral 65 designates a supporter which is fixed in the housing and is provided with a pair of opposing arms 66 of elastic material. These arms are provided one pair for each of the operation bodies 60*a* to 60*d*. Numeral 67 designates plates which are supported between the upper portions of the arms 66 and recesses formed in the operation body 60, respectively. In FIG. 9, the operation body 60 is in the first stable state and, if the push-button 61 is pushed down under this condition, the arms 66 are once opened to the outside by the plates 67 but then inverted by the resilient force of the arms 66 themselves to be set in the second stable state. The switch is actuated in the second stable state.

Figure 10:
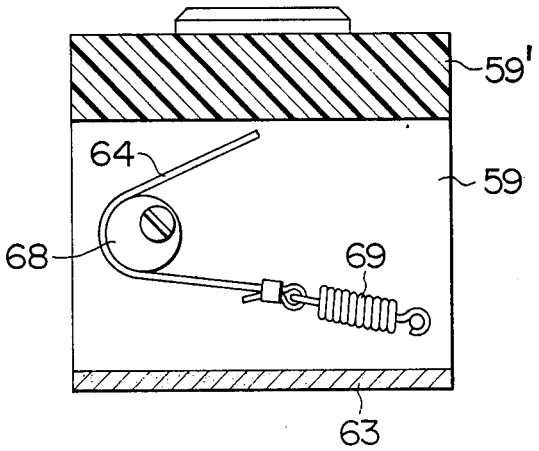
FIG. 10 is a side elevation of the embodiment of FIG. 8.
Figure 11:
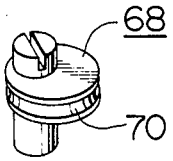
FIG. 11 is a perspective view of an eccentric cam.

FIG. 10 shows a slackness adjusting mechanism for the flexible wire 64, in which one end of the flexible wire 64 is guided by an eccentric cam 68 supported rotatably by a side plate of the housing 59 while the other end thereof is connected with one end of a spring 69 fixed at the other end to the side plate of the housing 59. FIG. 11 shows the eccentric cam 68 which has a groove 70 formed along its circumference. The flexible wire 64 can be adjusted in slackness by rotating the eccentric cam 68.

Next, the operation of this embodiment of the multiple push-switch will be described in conjunction with FIG. 8.

If, under the condition shown in FIG. 8, the push-button 61*a* is pushed down, as the operation body 60*a* is moved downward the flexible wire 64 is strained so that the flexible wire is operated to make the portion at the operation body 60*c* linear and, as a result, the operation body 60*c* is pushed up to be inverted to the first stable state. Then, the operation body 60*a* is changed to the second stable state and the switch corresponding to the operation body 60*a* is closed. Thus, as a result of pushing down the push-button 61*a*, the switch corresponding to the operation body 60*a* is turned ON while the switch corresponding to the operation body 60*c* is turned from ON to OFF.

Figure 12:
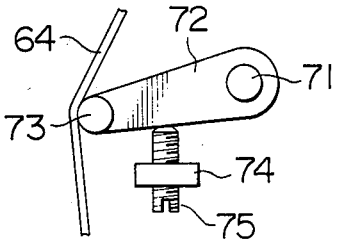
FIG. 12 is a front view of a slackness adjusting mechanism of a fourth embodiment of the present invention.
Figure 13:
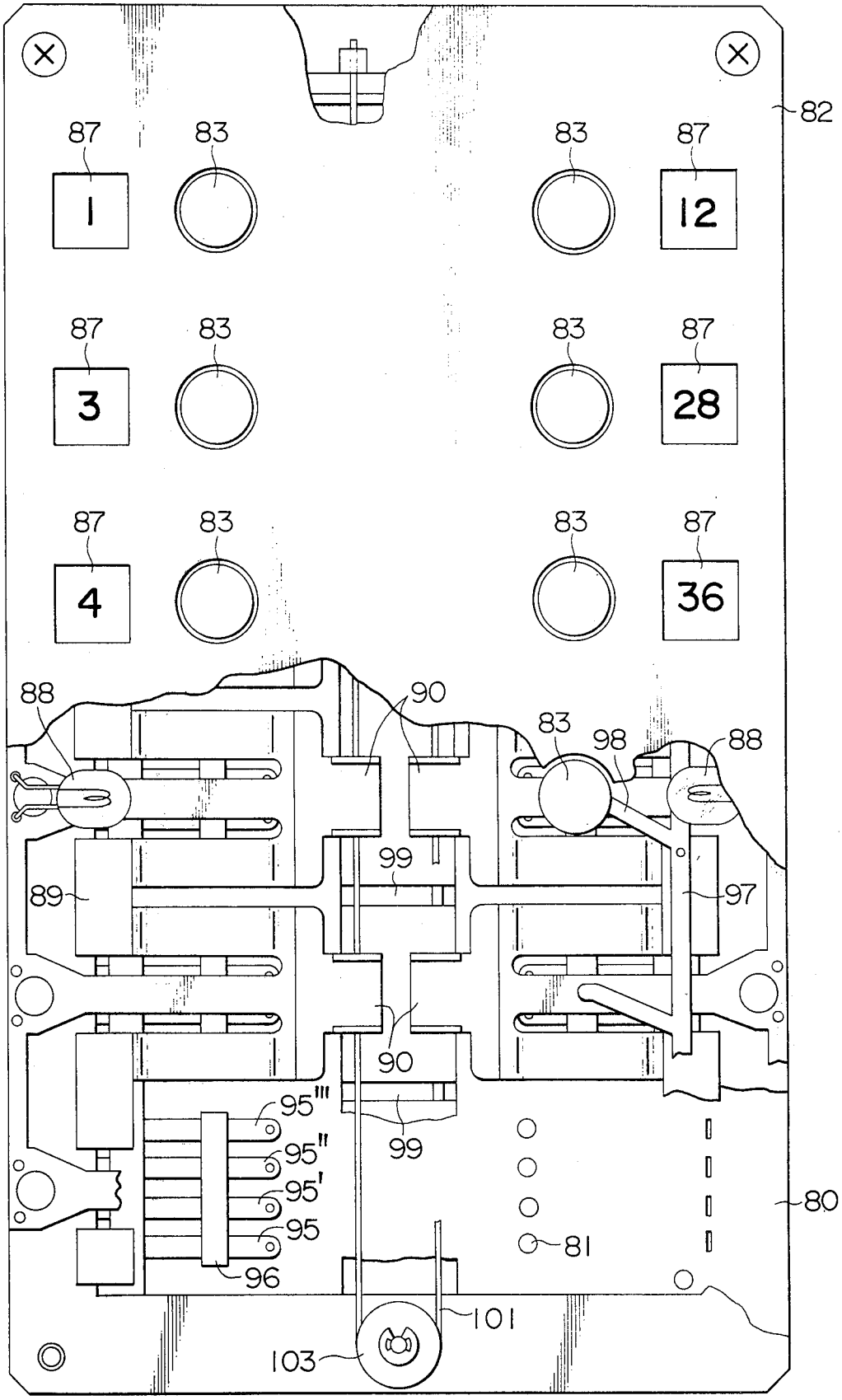
FIG. 13 is a switch apparatus mounted on a printed board in a fifth embodiment of a multiple push-switch apparatus according to the present invention.
Figure 14:
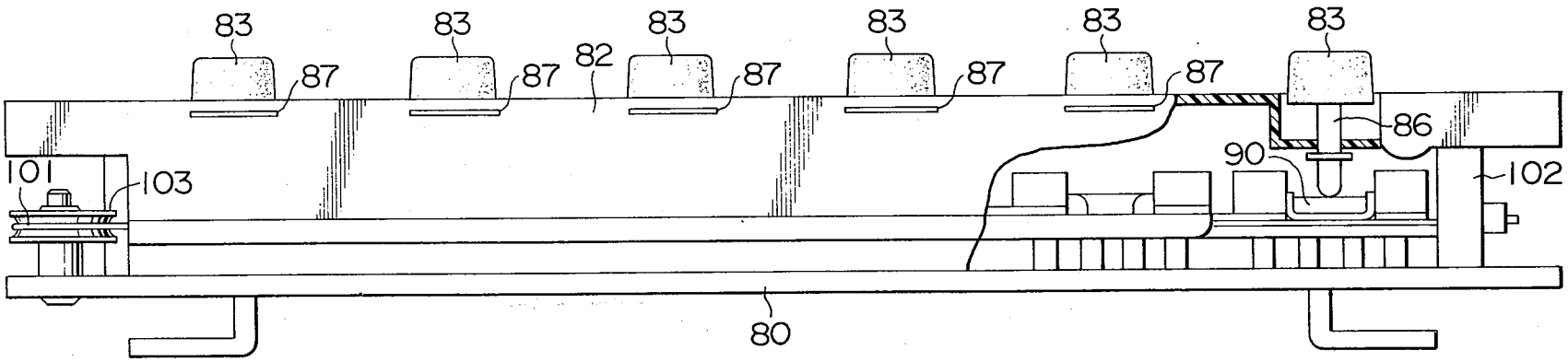
FIG. 14 is a side elevation of the switch apparatus of FIG. 13.

FIG. 12 shows a slackness adjusting mechanism of a fourth embodiment, in which an arm 72 which is supported rotatably through an axis 71 by a side plate of the housing 59 is provided at its top with a guide pin 73, and a nut 74 which is also fixed to the side plate is brought into engagement with a screw 75 whose end is adapted to control the rotation of the arm 72, that is, when the screw 75 is rotated, the arm 72 is also rotated, and the slackness of the flexible wire 64 which is guided by the guide pin 73 can be adjusted.

FIGS. 13 to 16 show a fifth embodiment of the present invention. In FIGS. 13 to 16, reference numeral 80 designates a printed board on the upper surface of which is formed a conductive pattern 81 serving as fixed contacts. Numeral 82 designates a case which is mounted on the printed board 80 and constitutes together with the printed board 80 a housing. On the upper surface of the case 82 are formed recesses 84 for receiving operation buttons 83 and windows 85 for displaying channel numbers. Numeral 86 designates operation rods which are provided on the lower surfaces of the operation buttons 83 and are inserted into openings formed in the base plates of the recesses 84. Numeral 87 designates channel displaying plates on which are displayed channel numbers, respectively, and which are inserted into the window 85 of the case 82. Numeral 88 designates lamps which are provided under the windows 85, respectively.

Reference numeral 89 designates a long supporting plate which is provided on the side portion of the upper surface of the printed board 80 and is provided with a plurality of bistable inversion mechanisms.

Figure 16:
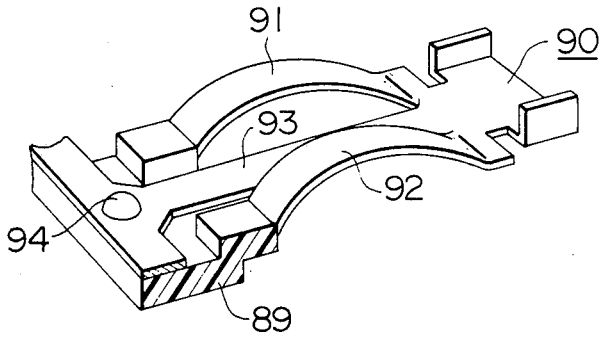
FIG. 16 is a perspective view of an inversion spring as a part of the switch apparatus of FIG. 13.

Next, the bistable inversion mechanism above will be described in conjunction with FIG. 16. Numeral 90 designates an inversion spring which is constructed by two bent plates 91 and 92 and one flat plate 93. One end of the flat plate 93 is fixed by a rivet 94 to the supporting plate 89, while the end portions of the bent plates 91 and 92 contact respectively to the side faces of the supporting plate 89. In FIG. 16, the bistable inversion mechanism is in the first stable state. If, under this condition, the flat plate 93 of the inversion spring 90 is pushed downwards, the inversion spring 90 is inverted; that is, the inversion spring 90 is brought into the second stable state. A plurality of the bistable inversion mechanism shown in FIG. 16 is formed by a single resilient plate. Numerals 95, 95', 95'', and 95''' designate movable contacts which are supported by an insulator 96 and are fixed at their respective one ends to the conductive pattern of the printed board 80. The loose ends of the movable contacts are opposed to the fixed contacts 81 provided on the printed board 80.

Reference numeral 97 designates a supporting plate fixed on the upper surface of the above supporting plate 89 and the operation rod 86 is fixed to the end of a supporting arm 98 projecting from the supporting plate 97. The supporting arm 98 has weak elasticity.

Reference numeral 99 designates a controlling plate which is fixed in the central portion of the printed board 80 and two grooves 90 and 90' are formed on the controlling plate. The controlling plate 99 is really formed in a plurality of numbers in the central portion of the printed board 80. Reference numeral 101 designates a flexible rope which is fixed at both ends to a board 102 mounted on the printed board 80. Reference numeral 103 designates a roller which is rotatably mounted on the printed board 80 in the portion contrary to the board and is adapted to guide the rope 81. Further, the rope is inserted into the grooves 100 and 100' in the controlling plate 99. The loose ends of the inversion spring 90 of the bistable inversion mechanism contact with the rope 101.

Next, the operation of the multiple push-switch apparatus above will be described in conjunction with Fig. 15.

Figure 15:
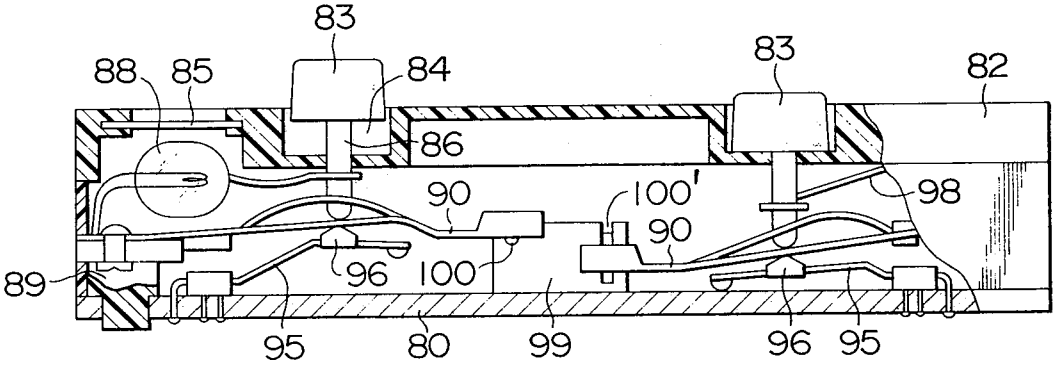
FIG. 15 is a lateral cross-sectional view of the switch apparatus of FIG. 13.
Figure 17:
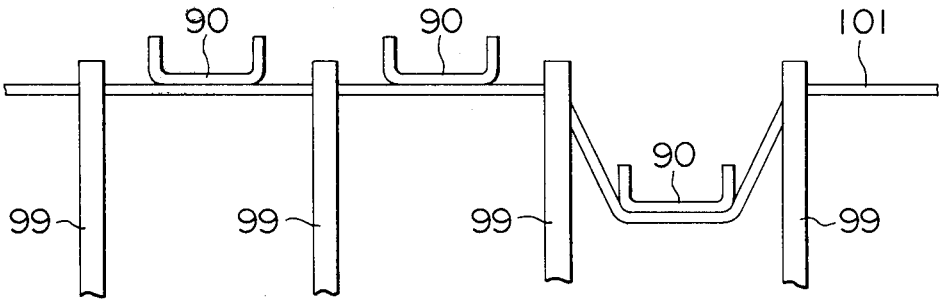
FIG. 17 is a view illustrating the state of a rope in the case of switching operation.

In FIG. 15, a bistable inversion mechanism on the right side is inverted to be set in the second stable state. Since, under this condition, the bistable inversion mechanism is in the second stable state, the movable contact is pushed downwards to be in contact with the fixed contact. Further, under the condition shown in FIG. 15, the rope 101 is depressed by the bistable inversion mechanism on the right side so as to be bent in the U shape as shown in FIG. 17.

If, under the condition shown in FIG. 15, the operation button 83 on the left side is pushed, the bistable inversion mechanism is inverted to close the switch and the rope 101 is bent in the U shape. However, since then the rope 101 is strained with the transition from the first stable state to the second stable state, the bistable inversion mechanism on the right side in FIG. 15 returns to its first stable state thereby opening the switch.

Figure 18:
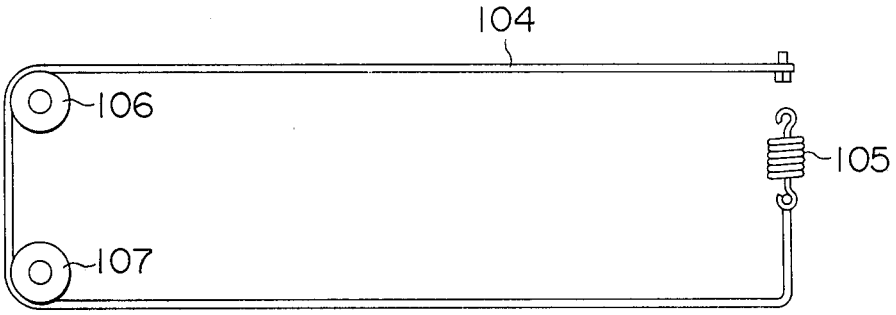
FIGS. 18, 19 and 20 are sixth, seventh and eighth embodiments of the present invention, respectively.

FIG. 18 shows a sixth embodiment of the present invention, in which a rope 104 is fixed at one end while the other end of the rope is fixed through a spring 105, thereby to be guided by two rollers 106 and 107.

Figure 19:
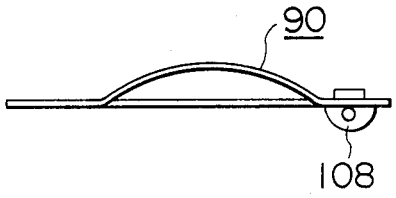
Figure 20:
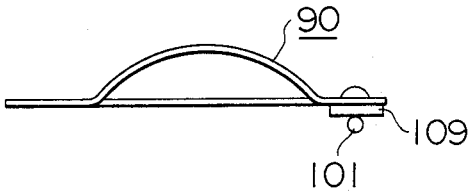

FIGS. 19 and 20 show seventh and eighth embodiments of the present invention, respectively. In FIG. 19, the inversion spring 90 of the bistable inversion mechanism is provided on the loose end with a friction body 108 of resin or the like having a hole, and the rope 101 is passed therethrough. In FIG. 20, the inversion spring 40 is provided with a friction plate 109 of resin or the like and the rope 101 is made to contact the plate. By the arrangements shown in FIGS. 19 and 20 the rope 101 is prevented from being broken by friction.

Figure 21:
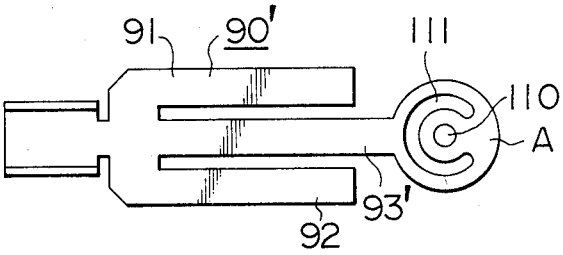
FIG. 21 is another example of the inversion spring shown in FIG. 16.

FIG. 21 shows another embodiment of the inversion spring shown in FIG. 16. At an end of the flat plate 93' of the inversion spring 90' shown in FIG. 21 there is provided a hole 110 for receiving a rivet or the like and a groove 111 formed in the shape of C circumferentially of the hole 110. When a rivet is inserted into the hole 110 of the inversion spring 90' shown in FIG. 21 and the spring is fixed to the supporting plate 89 shown in FIG. 16, the supporting point of the inversion spring 90' is in the portion A outside the hole 110. Thus, when this inversion spring 90' is used it is advantageous in that the length of the inversion spring becomes short.

Figure 22:
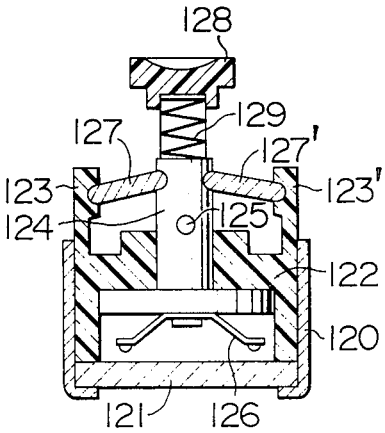
FIG. 22 is another example of the bistable inversion mechanism.

FIG. 22 shows another embodiment of the bistable inversion mechanism. In FIG. 22, reference numeral 120 designates a case which has a printed board 121 fixed thereto. Numeral 122 designates a supporting body which is fixed to the case 120 and has a pair of resilient arms 123 and 123' integrally formed thereon. Numeral 124 designates an operation body which is supported slidably up and down by the supporting body 122 and has a hole 125 for receiving a flexible rope. Numeral 126 designates a conductive elastic plate which is mounted on the lower end portion of the operation body 124 and serves as a movable contact. When the operation body 124 is displaced downward to cause the conductive elastic plate 126 to contact the fixed contact of the printed board 121, a closed circuit is formed. Numerals 127 and 127' designate plates each of which is engaged at one end with the recess of the arm 123 or 123' and at the other end with the recess of the operation body 124. Numeral 128 designates a push-button which is mounted through a spring 129 on the upper portion of the operation body 124. When the push-button 128 is mounted through the spring 129 as in this embodiment, even if a plurality of push-buttons are pushed by mistake, the pushing force can be absorbed by the spring thus preventing the rope from breaking by the pushing force.

Figure 23:
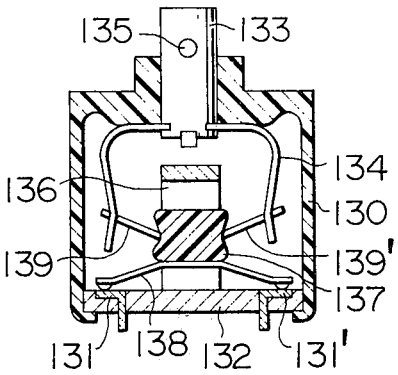
FIG. 23 is still another example of the bistable inversion mechanism.

FIG. 23 shows still another embodiment of the bistable inversion mechanism. In FIG. 23, reference numeral 130 designates a case which has a printed board 132 including fixed contacts 131 and 131' fixed on the lower portion thereof. Numeral 133 designates an operation body which is mounted slidably on the case 130 and an elastic plate 134 in the shape of an inverse U is fixed to the lower portion of the operation body 133. Numeral 135 designates a hole which is formed in the operation body 133 for receiving a flexible rope. Numeral 136 designates a controlling plate in the shape of an inverse U which is fixed to the printed board 132, and a movable body 137 is supported by the controlling plate 136 slidably in the up and down directions. Numeral 138 designates a conductive elastic plate which is mounted on the lower portion of the movable body 137 and serves as a movable contact. Numerals 139 and 139' designate plates each of which is engaged at one end with the elastic plate 134 and at the other end with the recess of the movable body 137. If, under the condition shown in FIG. 23, the operation body 133 is pushed downward, the inversion mechanism is inverted to displace the movable body 137 and also the conductive elastic plate 138 upward so that the fixed contacts 131 and 131' are disconnected. Thus, by employing the bistable inversion mechanism shown in FIG. 23, there can be provided a multiple push-switch apparatus which can close any and only one of the switches.

Figure 24:
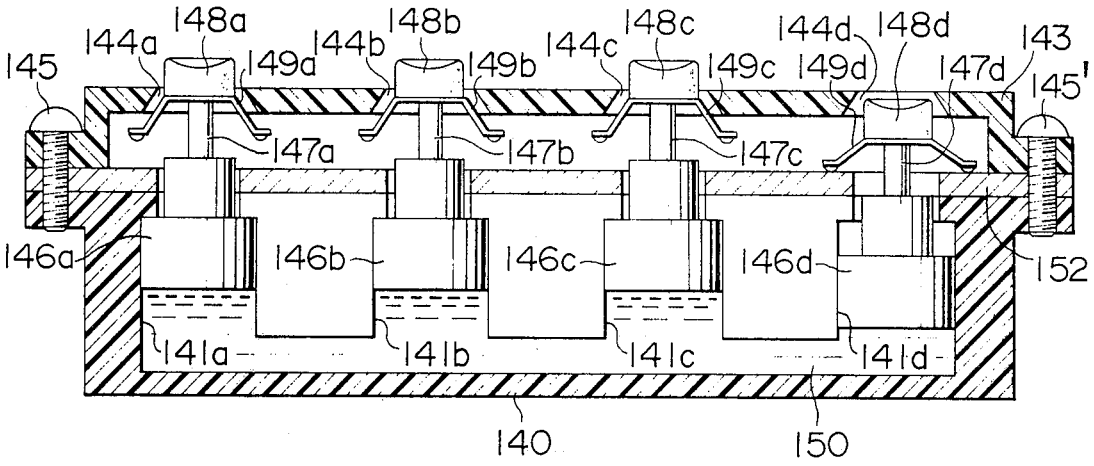
FIGS. 24 and 25 are 9th and 10th embodiments of the present invention in which fluid is employed.
Figure 25:
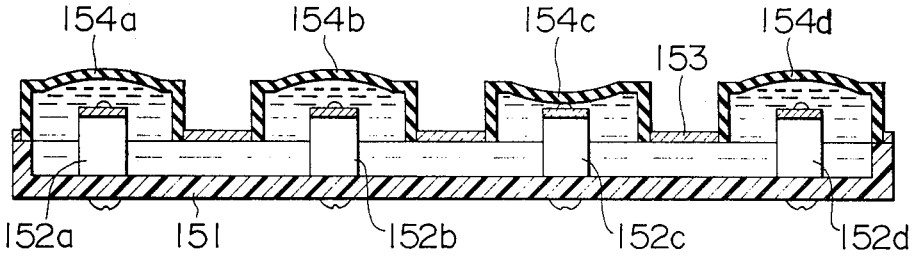

FIGS. 24 and 25 show ninth and tenth embodiments of the present invention, in which liquid and gas are employed. First, the ninth embodiment in FIG. 24 will be described. In FIG. 24, reference numeral 140 designates a lower housing which has a plurality of recesses **141*a*, 141*b*, 141*c* and 141*d* communicating with each other at their lower portions. Numeral 152 designates a printed board which has fixed contacts printed thereon. Numeral 143 designates an upper housing which has a plurality of holes 144*a*, 144*b*, 144*c* and 144*d* formed therethrough. The lower housing 140, the printed board 152 and the upper housing 143 are fixed to each other by screws 145 and 145'. Numerals 146*a*, 146*b*, 146*c* and 146*d* designate pistons which are slidably supported in the recesses 141*a*, 141*b*, 141*c* and 141*d* of the lower housing 140. Numerals 147*a*, 147*b*, 147*c* and 147*d* are operation bodies which are fixed to the pistons 146*a*, 146*b*, 146*c* and 146*d* and are provided with push-buttons 148*a*, 148*b*, 148*c* and 148*d* at the upper portions respectively. Numerals 149*a*, 149*b*, 149*c* and 149*d* designate movable contacts which are fixed to the operation bodies 147*a*, 147*b*, 147*c* and 147*d*, respectively. Numeral 150 is a fluid which is enclosed in airtight manner within the lower housing 140. In FIG. 24, only the push-button 148*d* is in the depressed state. If, under this condition, the push-button 148*a*, for example, is pushed down, the piston 146*a* is lowered. As a result, the fluid applies pressure to make the piston 146*d*** move upward. Thus, the exclusive operation can be realized.

FIG. 25 shows a tenth embodiment of the present invention or another embodiment employing fluid. Reference numeral 151 designates a housing, numerals **152*a*** to 152*d* designate supporting members which are mounted on the housing 151 and have fixed contacts mounted on their upper portions, respectively. Numeral 153 designates a panel which is mounted in airtight manner on the upper surface of the housing 151 and has conductive inversion diaphragms 154*a* to 154*d* mounted in airtight manner on the openings of the panel 153. The space enclosed by the housing 151, the panel 153 and the inversion diaphragm 154*a* to 154*d* is filled with a fluid.

In FIG. 25, only the inversion diaphragm 154*c* is inverted to contact with the fixed contact. If, under this condition, the inversion diaphragm 154*a*, for example, is depressed to be inverted, the fluid applies pressure to cause the inversion diaphragm 154*c* to be inverted to its original state. Thus, the exclusive operation can be realized.

The present invention which can be embodied by the above-described construction brings forth the following effects.

(1) Since conventional cam plates are not used, the electric switches can be switched by the application of a soft touch.

(2) It is possible to arrange a plurality of push-buttons in any desirable configuration such as in a plurality of rows, in a ring shape, etc.

(3) The construction becomes simple especially when a rope is used.

(4) It does not occur that a plurality of electric switches are closed by mistake.

What is claimed is:

1. A multiple push-switch apparatus comprising a plurality of operation bodies each supported for translation with respect to a housing along a longitudinal axis, a plurality of bistable inversion mechanisms each having a resilient body which translates the associated operation body in one direction along said axis, each of said bistable inversion mechanisms being inverted by the resilient force of said resilient body when the operation body associated with the bistable inversion mechanism is depressed in the opposite direction along said axis to oppose the resilient force of said resilient body, a plurality of switching mechanisms each closing when the associated bistable inversion mechanism is inverted, and an elongated flexible element loosely attached to said operation bodies, both ends of said flexible element being fixed such that said element is strained with a predetermined amount of slackness, wherein, when any one of said operation bodies is depressed the bistable inversion mechanism associated with said depressed operation body is inverted and another bistable inversion mechanism, which was in its inverted state before depression of said one of said operation bodies, is restored as said flexible member is strained by the depression of said one operation body.

2. A multiple push-switch apparatus as claimed in claim 1 which further includes a slackness adjusting mechanism for said flexible wire comprising a spring and eccentric cam secured to said housing, said flexible member being secured directly to said housing at one end and to said spring at the other end, said flexible member being guided around said eccentric cam.

3. A multiple push-switch apparatus as claimed in claim 1, wherein each of said bistable inversion mechanisms has a flat central portion and bent lateral portions which form an inversion spring cut from a rectangular elastic plate, said flat central portion being secured at the front end thereof to a supporting member, the front ends of said bent lateral portions contacting said supporting member.

4. A multiple push-switch apparatus as claimed in claim 3, wherein said inversion spring is provided at the free end thereof with a movable contact, said movable contact contacting a corresponding fixed contact upon inversion of said inversion spring.

5. A multiple push-switch apparatus as claimed in claim 3, wherein a plate spring fixed at one end thereof and having a movable contact is provided below said inversion spring, said plate spring being displaced upon the inversion of said inversion spring.

6. A multiple push-switch apparatus as claimed in claim 1, wherein said bistable inversion mechanism comprises a pair of resilient arms disposed at both sides of said operation body, and plates each of which is engaged at one end with said operation body and at the other end with one of said arms.

7. A multiple push-switch apparatus as claimed in claim 1, wherein said bistable inversion mechanism comprises an elastic plate in the shape of an inverse U mounted on said operation body, a movable body having a movable contact and being supported for slidable movement along said longitudinal axis, and plates interposed between said elastic body and said movable body.

8. A multiple push-switch apparatus as claimed in claim 3, wherein said flat central portion of said inversion spring has a C-shaped groove formed at the front end thereof, said central portion being secured to said supporting member at a point surrounded by said groove.

* * * * *